United States Patent [19]

Hamilton

[11] 4,309,229

[45] * Jan. 5, 1982

[54] METHOD OF GENERATING WATER VAPOR FREE GAS

[75] Inventor: Brian K. Hamilton, Saugus, Calif.

[73] Assignee: Allied Chemical Corporation, Morris Township, Morris County, N.J.

[ * ] Notice: The portion of the term of this patent subsequent to Apr. 13, 1993, has been disclaimed.

[21] Appl. No.: 751,502

[22] Filed: Dec. 17, 1976

Related U.S. Application Data

[60] Continuation-in-part of Ser. No. 645,847, Dec. 31, 1975, abandoned, which is a division of Ser. No. 387,406, Aug. 10, 1973, Pat. No. 3,950,009, which is a continuation of Ser. No. 224,524, Feb. 8, 1972, abandoned.

[51] Int. Cl.[3] ..... C06D 5/00

[52] U.S. Cl. ..... 149/82; 149/109.6

[58] Field of Search ..... 149/82, 109.6

[56] References Cited

U.S. PATENT DOCUMENTS

| | | | |
|---|---|---|---|
| 3,052,577 | 9/1962 | Butler et al. | 149/82 X |
| 3,180,373 | 4/1965 | Hebenstreit | 149/77 X |
| 3,647,393 | 3/1972 | Leising et al. | 23/281 |
| 3,711,115 | 1/1973 | Lohr | 280/150 AB |
| 3,773,351 | 11/1973 | Catanzarite | 102/39 X |
| 3,833,432 | 9/1974 | Moy et al. | 149/193 |

FOREIGN PATENT DOCUMENTS

| | | | |
|---|---|---|---|
| 15022 | of 1897 | United Kingdom | 149/82 |

*Primary Examiner*—Edward A. Miller

*Attorney, Agent, or Firm*—Roger H. Criss; Ernest D. Buff

[57] ABSTRACT

A chemical gas generant mixture of carbon, an oxidizer which does not contain hydrogen and, optionally, a carbonate or other coolant.

6 Claims, 1 Drawing Figure

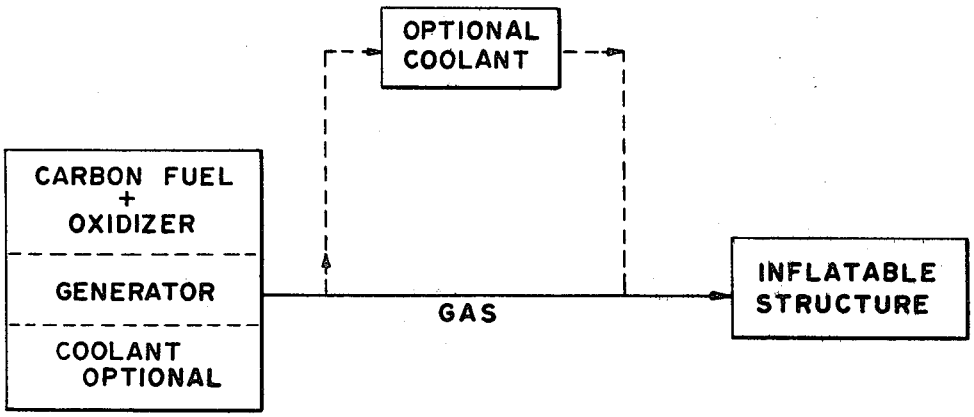
OPTIONAL
COOLANT
CARBON FUEL
+
OXIDIZER
GENERATOR
COOLANT
OPTIONAL
GAS
INFLATABLE
STRUCTURE

METHOD OF GENERATING WATER VAPOR FREE GAS

CROSS-REFERENCE TO RELATED APPLICATIONS

This is a continuation-in-part of application Ser. No. 645,847, now abandoned, which, in turn, is a divisional of application Ser. No. 387,406, now U.S. Pat. No. 3,950,009, which in turn is a continuation of application Ser. No. 224,524, filed Feb. 8, 1972, now abandoned.

BACKGROUND OF THE INVENTION

Automobile safety has indicated the use of inflatable structures such as air cushion systems for passenger restraint. Much research and development has recently been carried out in the development of such air cushion systems both for the protection of passengers, as disclosed for example in U.S. patent application Ser. No. 81,947, filed Oct. 19, 1970, now U.S. Pat. No. 3,874,059, and for the protection of the driver, as for example in U.S. patent application Ser. No. 147,913, filed May 28, 1970, now U.S. Pat. No. 3,787,074. In both the case of the protection of the passenger and the driver, the gas used to fill the protective cushion or bag may be in part or all generated gas from a combustible material.

It is necessary that the generated gas withstand storage from about −40° F. to +220° F., will ignite rapidly, for example within just a few milliseconds, to be totally ignited and producing gas, and produce non-toxic gas at a relatively low temperature (less than about 2000° F.) when burned at pressures from 100 to 20,000 lbs/in$^2$. One problem with current combustible mixtures is that copious quantities of water vapor are produced as a product of combustion, since the fuels used are composed of carbon, hydrogen and oxygen components. The water vapor condenses on the inflated structure (the air cushion or bag), carrying considerable heat with it, which raises the temperature of the inflated structure to undesirable levels. This is particularly true if the inflated structure is porous, which is typical of at least a part of most air cushions utilized.

SUMMARY OF THE INVENTION

In accordance with the present invention, a combustible mixture of carbon, an oxidizer which does not contain hydrogen and, optionally, a coolant are mixed to form a combustible material which produces non-toxic gas rapidly, at relatively low temperature, and without the production of water vapor.

In a specific embodiment, the combustible mixture is formed of a relatively pure carbon product, such as "carbon black" or powdered graphite, an oxidizer not containing hydrogen, such as a metal chlorate or perchlorate, or a combination of the two, and, optionally, a carbonate to absorb heat by its decomposition.

DESCRIPTION OF THE PREFERRED EMBODIMENT

Inflating gas produced by the method and composition of this invention is cool, non-toxic, incondensible and substantially free of particulate matter. As a consequence the invention will be found to function with most varieties of inflatable structures. For illustrative purposes, the invention is described in connection with a method for supplying gas to expand an inflatable restraint. However, the invention is intended to encompass modifications of this embodiment including those in which inflating gas is supplied to inflatable structures such as inflatable smoke barriers and jump nets used in fire rescue, aircraft escape slides, life rafts, flotation bags and the like.

In the preferred embodiment of this invention, the combustible mixture is made up of a carbon bearing material from a relatively pure carbon source (i.e. a carbon source having less than 5 mol % hydrogen). Specific examples of such carbon material are carbon black or powdered graphite. In the preferred embodiment of the invention, the carbon is combined in a mixture with an oxidizer which does not contain hydrogen, particularly any metal chlorate and/or perchlorate, such as potassium perchlorate ($KClO_4$) and/or potassium chlorate ($KClO_3$).

The combustible mixture can be used as a loose powder or mechanically compacted, as by a ram or press, or fused, as by wetting the mixture and drying it in place or by means of the addition of a known binder not specifically altering the mixture so as to produce significant quantities of water vapor.

The mixture described is over-oxidized when burned to such an extent that a negligible concentration of CO is produced. The excess oxidizer cools the reaction either by itself of in combination with a coolant which may optionally be added to the mixture before burning, or through which the generated gas from the combustion may be passed. The coolant is preferably a carbonate, such as magnesium carbonate and/or sodium carbonate which will absorb heat as a result of decomposition. Additional cooling of the generated gas may be obtained by passing said gas through a porous bed of a heat-absorbing material or loosely arranged metal or other mechanical cooling medium, such as chain, wire or porous sintered metal.

As shown in the drawing, which is a schematic of a process according to the invention, generated gas is passed to an inflatable structure from the generator and, optionally, cooled either by coolant in the combustible mixture or separately. In one specific example, 6 grams of lamp black were mixed with 140 grams of potassium perchlorate. The gas produced was at a temperature of about 1600° F. and then was directed through 320 grams of steel chain and filled a nylon porous air cushion of about 4 cubic feet, when inflated. The inflated bag remained cool to the touch of a human hand after filling. Of course, the addition of a chemical coolant, such as a carbonate which will absorb heat on decomposition as a result of its mixture to the combustible mixture itself or as a result of its contact with the generated gas after combustion further markedly lowers the temperature of the generated gas.

It is understood that the above-described example and general descriptive matter is merely illustrative of the invention and not meant to limit said invention, except as such invention is within the scope of the following claims.

I claim:

1. A method of supplying generated gas to expand an inflatable structure without the production of substantial water vapor during gas generation, comprising the steps of:

a. preparing a mixture consisting essentially of:

1. an oxidizer which does not contain hydrogen, said oxidizer being selected from the group consisting of metal chlorates and perchlorates;

2. a carbon material selected from the group consisting of carbon black and graphite;

3. a carbonate coolant;

b. burning said mixture to produce a gas; and c. directing the gas into the inflatable structure.

2. A method as recited in claim 1, further comprising compacting the unburned mixture of oxidizer, carbon material, and carbonate coolant with a binder.

3. A method as recited in claim 1, further comprising additionally cooling the produced gas after burning said mixture.

4. A method as recited in claim 1, wherein said inflatable structure is selected from the group consisting of smoke barrier, jump net, aircraft escape slide, life raft and flotation bag.

5. The method of claim 1 wherein said carbon material is carbon black.

6. The method of claim 5 wherein said oxidizer is potassium chlorate and said coolant is magnesium carbonate.

* * * * *